United States Patent [19]

Haile

[11] Patent Number: 4,917,625

[45] Date of Patent: Apr. 17, 1990

[54] SNAP-ON ELECTRICAL CONNECTOR FOR ELECTRICAL CORDS HAVING MATING PLUGS

[76] Inventor: Ernest Haile, 30 Cadwalader Ter., Trenton, N.J. 08618

[21] Appl. No.: 259,549

[22] Filed: Oct. 18, 1988

Related U.S. Application Data

[63] Continuation-in-part of Ser. No. 223,330, Jul. 25, 1988, abandoned.

[51] Int. Cl.[4] ..... H01R 13/627

[52] U.S. Cl. ..... 439/358; 439/271; 439/369

[58] Field of Search ..... 439/299, 300, 350, 353, 439/354, 355, 356, 357, 358, 366, 367, 368, 369, 370, 371, 628, 651, 871, 905, 271, 272, 351, 352

[56] References Cited

U.S. PATENT DOCUMENTS

| | | | |
|---|---|---|---|
| 2,459,032 | 1/1949 | Korth | 439/651 X |
| 3,051,925 | 8/1962 | Felts | 439/357 |
| 3,097,034 | 7/1963 | Jamrosy | 439/369 |
| 3,737,833 | 6/1973 | Jerominek | 439/369 |
| 3,999,828 | 12/1976 | Howell | 439/369 |
| 4,211,461 | 7/1980 | Wescott | 439/357 |
| 4,239,319 | 12/1980 | Gladd et al. | 439/651 X |
| 4,449,776 | 5/1984 | Carmo et al. | 439/350 |
| 4,601,528 | 7/1986 | Spier | 439/148 |
| 4,664,463 | 5/1987 | Carmo | 439/369 |
| 4,675,779 | 6/1987 | Neuwirth | 439/271 X |

*Primary Examiner*—Neil Abrams
*Assistant Examiner*—Khiem Nguyen
*Attorney, Agent, or Firm*—Sperry, Zoda & Kane

[57] ABSTRACT

Disclosed is an electrical connector designed to be interposed between male and female plugs provided upon the ends of electrical cords. The connector includes springable arms having shoulders interengaging with shoulders formed on the adjacent ends of the plugs, in such fashion as to lockably engage the plugs and thereby prevent separation of the cords during use. Within the connector there are provided electrical connector elements each having a female and a male end, adapted to mate with the electrical elements of the plugs, thus providing a through electrical connection for the cords, while assuring that they will be held against inadvertent separation. In another form the invention omits the provision of electrical connector elements within the connecting device itself. Instead, a yoke or retainer, usable in both forms of the invention has its spring arms again engaging shoulders on the plugs, with the plugs in this instance interengaging directly as well as being releasably, lockably engaged with the retainer.

8 Claims, 4 Drawing Sheets

FIG. 5
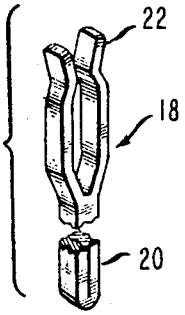
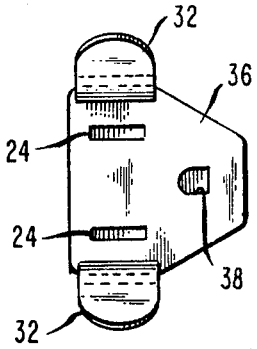
FIG. 9
FIG. 6
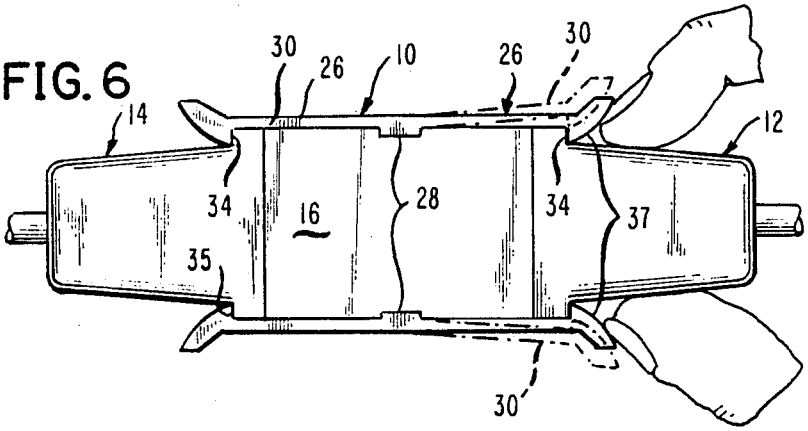
FIG. 7
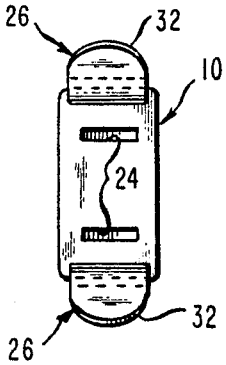
FIG. 8
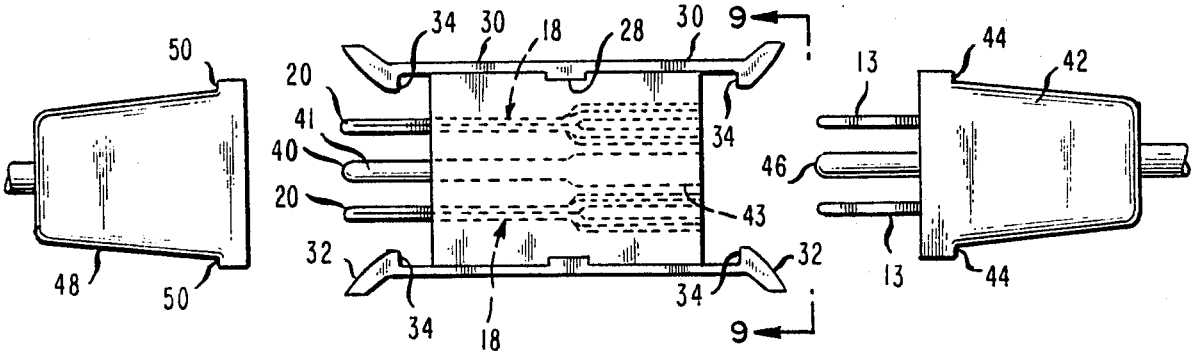
FIG. 10
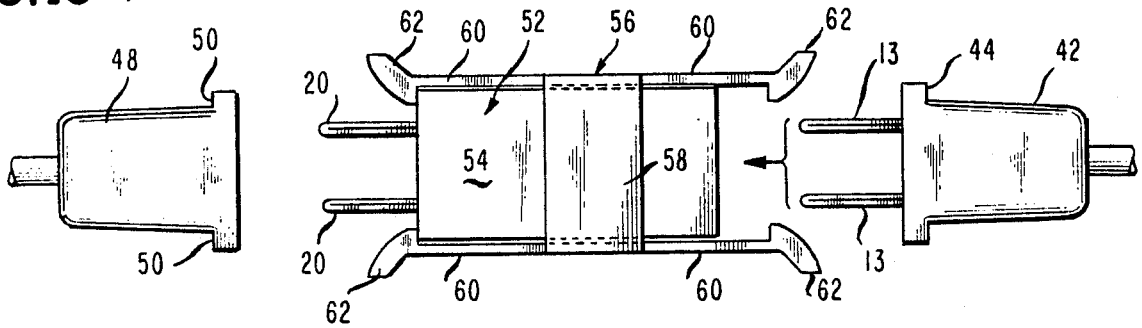

FIG. 11
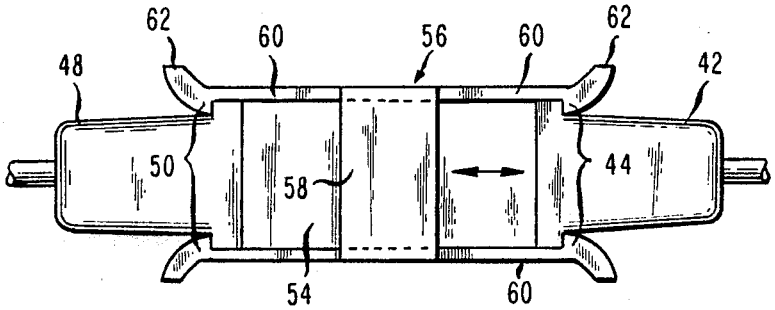
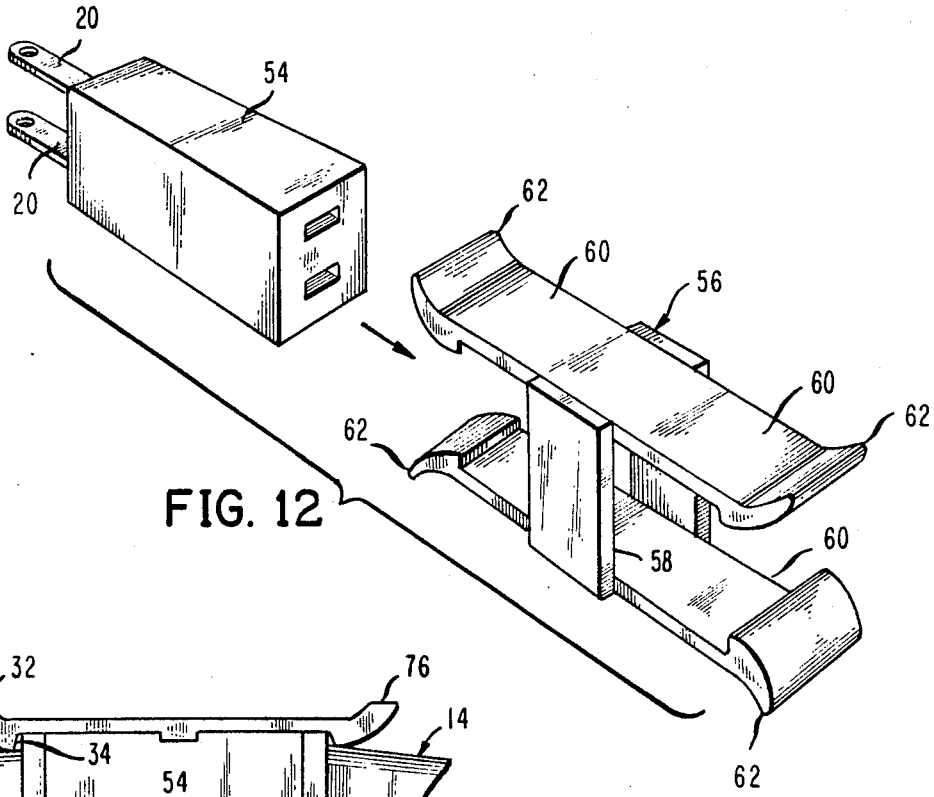
FIG. 12
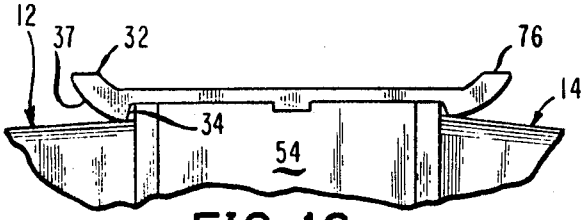
FIG. 16
FIG. 13
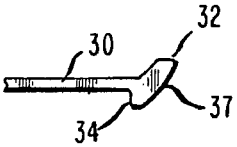
FIG. 15
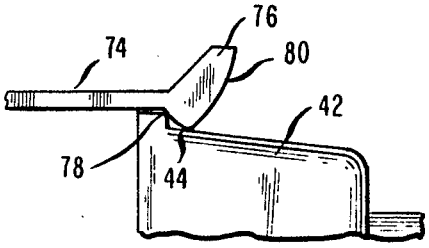
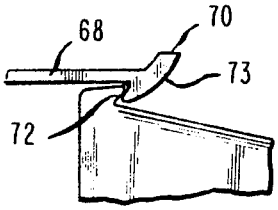
FIG. 14

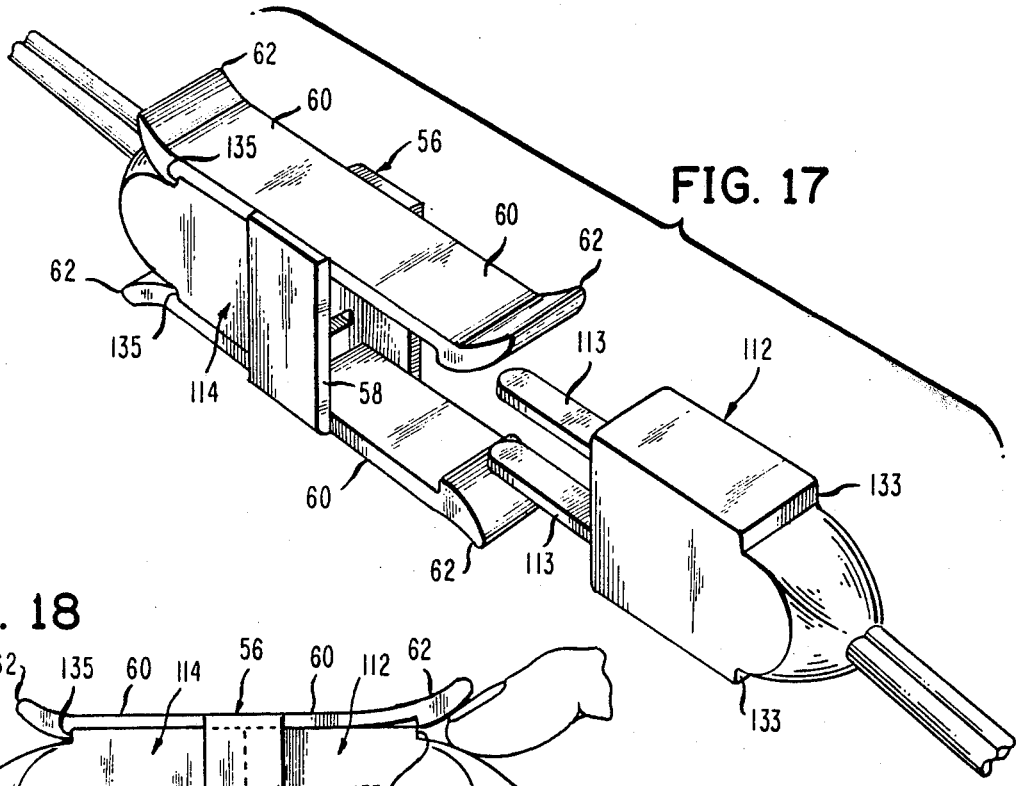
FIG. 17
FIG. 18
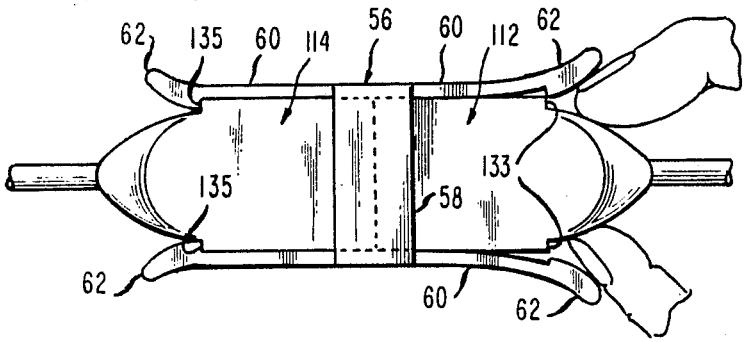
FIG. 19
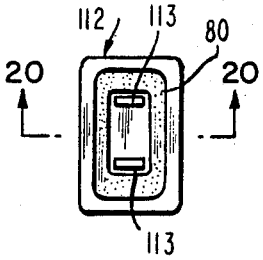
FIG. 21
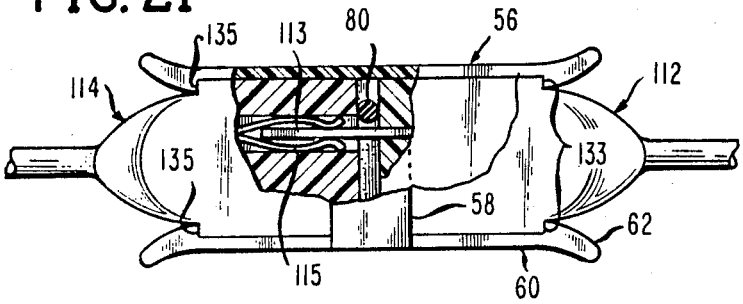
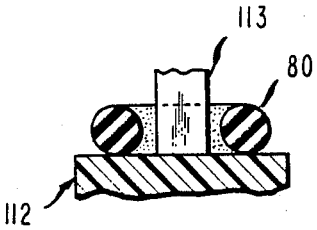
FIG. 20
FIG. 22
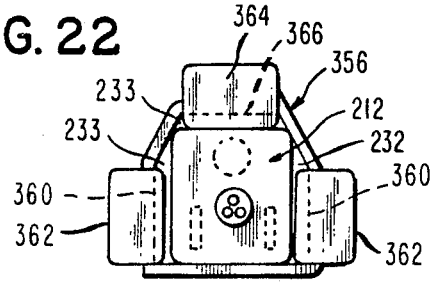

SNAP-ON ELECTRICAL CONNECTOR FOR ELECTRICAL CORDS HAVING MATING PLUGS

CROSS REFERENCE TO RELATED APPLICATION

The present application is a continuation-in-part of Application Ser. No. 223,330 filed July 25, 1988, now abandoned.

BACKGROUND OF THE INVENTION

1. Field Of The Invention

The present invention relates generally to the field of wiring devices, and in particular, has reference to devices of this character that are utilized for preventing the mating ends of electrical cords from accidental separation.

2. Description Of The Prior Art

It has been proposed, heretofore, to provide devices for preventing electrical cords from accidental separation, during use. However, the devices heretofore devised have in some instances required revision of the plugs found upon the electrical cords in ways that have added considerably to the cost of manufacture thereof. In other instances, the means used for preventing the accidental separation of the electrical cords has been exceedingly complex, and has caused the connector means to be capable of production only at costs that are so high as to militate against their commercial feasibility.

In still other instances, the time required for interlockably engaging the electrical cords has been excessive, as a result of which the users of the locking means have tended to avoid the regular and habitual use of the devices intended for preventing the accidental separation of the cords. Or, it has in still other cases been true that the devices can be separated from the electrical cords only at the cost of valuable time, so as to again result in the tendency of a user to avoid the means provided for locking the cords against accidental separation.

It has, of course, been heretofore provided, under the standards set up by such safety organizations as Underwriters Laboratories, that certain special configurations of plugs can be employed for the purpose of preventing accidental separation of the plugs provided upon the ends of electrical cords. These, for example, include the devices in which a twisting or rotary action is utilized, after the plugs have been connected, whereby the plugs are counter-rotated and in this way lockably engaged with each other. These plug configurations have, however, not been intended for normal residential use, but rather, are designed primarily for industrial usage.

SUMMARY OF THE INVENTION

The present invention has, as its main purpose, the provision of a device adapted to be interposed between the plugs of electrical cords, in such a way as to permit swift connection of the device to each of the plugs, responsive merely to insertion of the plugs in the opposite ends of the device comprising the present invention. This causes the plugs to be locked against accidental separation from the connector comprising the present invention, and it follows that the electrical cords themselves are thereby prevented against being pulled apart under conditions which could cause danger to the user of an electrical appliance to which current is being supplied through the electrical cords. Or, at the very least, inconvenience and loss of time may result from the accidental separation of the cords.

The device comprising the present invention is in the form of a simply molded block of electrically insulative material, in which there are embedded electrical connector elements, each of which has a male and female end. The male ends or prongs of the electrical elements project beyond one end of the block, while the female elements are recessed in the opposite end thereof. As a result, the male ends can engage in the female receptors of a conventional electrical plug provided upon the end of one electrical cord, while the female ends of the connector elements receive the prongs of a male plug provided upon the end of a cooperating electrical cord.

Provided upon the block are springable snap arms, each of which projects beyond the opposite ends of the block, and is provided, at its distal end, with a head on which there is a locking shoulder. The locking shoulder engages a cooperating shoulder provided upon the adjacent plug, and the head is so shaped that it requires only the insertion of the plug in the connector device, to produce an interlock of the plug with said device.

Then, when the electrical cords are to be intentionally disconnected, one need only position the thumb and forefinger of one's hand against the headed ends of the arms, to spread the arms and thereby disconnect them from the plug with which they have been interlockably engaged, thereby permitting the swift and easy disconnection of the cords from the device.

In another form of the invention, the block having electrical connector elements embedded therein is omitted. Instead, shoulders are provided upon male and female plugs, spaced from the faces of the plugs, at locations where they will be engaged by springable snap arms of a separately formed retaining device. In this form, the male and female elements of the plugs are directly interengaged in a conventional manner. This locates the shoulders of the plugs in positions to be directly interlocked with the shoulders of spring arms on the separately formed retainer or locking yoke.

If desired, the device can be left upon one or the other plug, awaiting the next use thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 5 is a perspective view, a portion being broken away, of one of the connector elements provided in the connector device comprising the present invention;

FIG. 6 is a side elevational view of the device in which the plugs are shown in full lines fully connected to the connector, and the dotted lines show a pair of the spring arms being urged apart by the thumb and forefinger of one's hand;

FIG. 7 is an end elevational view of the device as seen from the line 7—7 of FIG. 1;

FIG. 8 is a view similar to FIG. 1 showing a modified form of the device, wherein the device is designed as a connector for grounded plugs;

FIG. 9 is an end elevational view of the modified form of the device shown in FIG. 8, as seen from line 9—9 of FIG. 8;

FIG. 10 is a side elevational view of yet another form of the invention, in which the springable locking means is slidably mounted upon the associated block;

FIG. 11 is a view of the device shown in FIG. 10, with the plugs fully interlocked therewith;

FIG. 12 is an exploded perspective view of the modified device of FIG. 10;

FIG. 13 is a fragmentary side elevational view of the form of the spring arms used in the modifications of FIGS. 1–11;

FIG. 14 is a view similar to FIG. 13 showing a modified form of the spring arm in locking engagement with a plug having matching shoulders;

FIG. 15 is a fragmentary, side elevational view showing yet another modification of the spring arm, in locking engagement with a plug of an electrical cord;

FIG. 16 is a fragmentary side elevational view showing another modification in locking engagement with male and female plugs;

FIG. 17 is a partially exploded perspective view of a further modification in which the yoke or retainer of FIG. 12 is used without a connector block, and in which the plugs are so formed as to interengage directly with each other and will, when so interengaged, also be lockably interengaged with the retainer;

FIG. 18 is a side elevational view of the modified device shown in FIG. 17, with two of the spring arms being spread by the fingers of a user's hand preliminary to disengaging one of the plugs from the other;

FIG. 19 is a face view of the male plug shown in FIG. 17, showing yet another feature comprising a compressible gasket whereby a waterproof connection may be made between the plugs of FIG. 18;

FIG. 20 is an enlarged, detail, fragmentary sectional view substantially on line 20—20 of FIG. 19;

FIG. 21 is a view partly in side elevation and partly in longitudinal section, showing the plugs of FIG. 18 as they appear when used in association with a gasket of the type shown in FIGS. 19 and 20; and FIG. 22 is a rear view of a further modification.

BRIEF DESCRIPTION OF THE PREFERRED EMBODIMENTS

Figure 1:
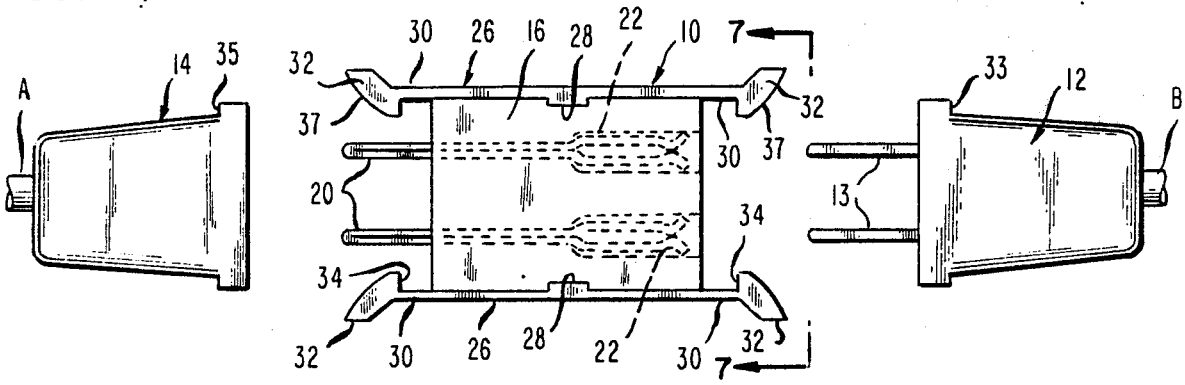
FIG. 1 is an exploded, side elevational view, showing the device interposed between a pair of plugs provided upon the ends of electrical cords, the cords being illustrated fragmentarily, and the plugs being shown in the position in which they would be placed immediately prior to being joined to the electrical connector.
Figure 2:
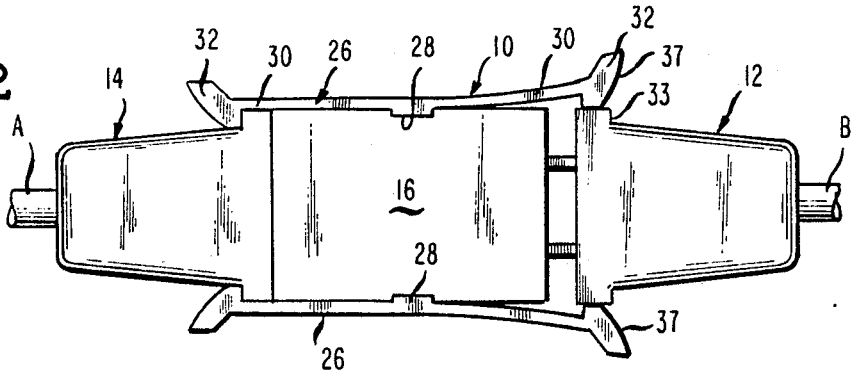
FIG. 2 is a side elevational view in which one plug has been fully, interlockably engaged with the connector, and the other device is nearing its final, locked position.
Figure 3:
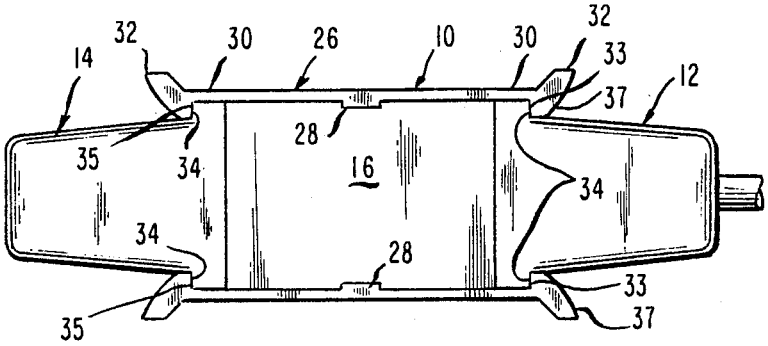
FIG. 3 is a side elevational view in which both plugs have been fully, interlockably engaged with the connector comprising the present invention.
Figure 4:
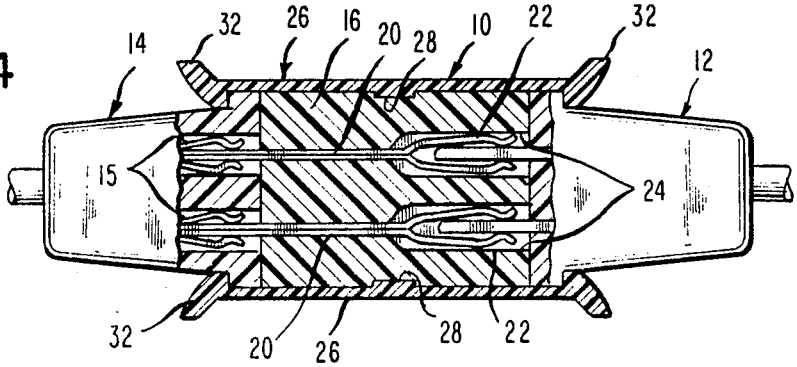
FIG. 4 is a view partly in longitudinal section and partly in side elevation, showing the plugs fully connected to the connector.

Referring to the drawing in detail, in the form of the invention shown in FIGS. 1–7 the connector device comprising the invention has been generally designated 10 and is illustrated in association with conventional plugs 12, 14 found upon the ends of electrical cords A, B. Plug 12 is a conventional plug having male prongs 13, while plug 14 is a conventional female plug having receptor elements 15 (FIG. 4).

Normally, plugs 12, 14 are connectable directly to each other. However, it is well known that when excessive pull is exerted upon the electrical cords, this may result in disconnection of the plugs 12, 14 accidentally. In some instances, if the cord is lying in wet grass or even in a puddle of water, this may result in short circuiting. Or, at the very least, the user suffers the inconvenience of having an electrical appliance go dead, as a result of which time must be taken to re-connect the electrical cords.

Although devices have been heretofore conceived for the purpose of accidental disconnection of electrical cords, they have not found popular favor, for the reason that in many instances, they are costly, or may not conform to safety standards, or may be too difficult to use, both when connecting and disconnecting the cords.

The connector device 10 comprising the present invention includes, in the form of FIGS. 1–7, a rectangular block of electrically insulative material, such as, for example, a phenolic resin or a polyvinyl. Both of these, and indeed other substances, are commonly used as the materials for molding the bodies of electrical wiring devices, and are well suited for molding, on a production basis, the body of the connector device 10.

In the form of FIGS. 1–7, this device is rectangular both in side elevation and in end elevation (see FIG. 7).

Within the body there are embedded or otherwise permanently mounted a pair of identical connector elements 18 (FIG. 5). Each may be formed as a strip of electrically conductive metal folded upon itself, to provide a folded male prong 20, and a female receptor member 22 engaged in slots 24 (see FIG. 4) that are molded in one end of the block 16.

Permanently secured to opposite faces of the block 16 are springable retainer members 26. These may be formed either of metal or of any other springable material, including, for example, molded or extruded plastic.

It is mainly important that the retainer members be of a springable material, and in the present instance, this is accomplished by having each retainer member formed as a single piece of springable material, with an enlarged midportion 28 which can be embedded in the material of the body 16 during the molding of the body, thereby to permanently connect the retainer member, at its center, to the mid-length area of the body. The arms 30 of the springable retainer members are left free, being tensioned to normally lie in face-to-face contact with the adjacent faces of the body 16 to which they are permanently joined. It may be noted, at this instance, that the permanent joining of the retainer members to the body 16 could, if the material of the members 26 and body 16 are compatible, be accomplished by ultrasonic welding or a similar expedient well known in the plastic molding art.

Formed on the opposite ends of each retainer member 26 are locking heads 32. In the form of the invention shown in FIGS. 1–7, and also in FIG. 13, these heads are enlargements on the distal ends of the arms 30, and are disposed a distance away from the adjacent end faces of body 16 slightly greater than the thickness of shoulders 33, 35 provided upon the plugs 12, 14. It may be noted that it is conventional practice in the manufacture of electrical cords having plugs of the type illustrated, to provide such shoulders for the purpose of facilitating the grasping of the plugs when connecting or disconnecting the same from mating plugs or receptacles.

Each head 32 has a shoulder or abutment 34 that faces toward the adjacent end of body 16. As a result, when a plug such as the plug 12 or 14 is to be connected to the connecting device 10, initially the end of the plug will bear against a beveled or cam surface 37 provided upon the head 32 of each retainer member 26. This will cause the retainer member to be pushed outwardly to the position shown in FIG. 2 at the right hand end of each retainer, viewing the same as in that figure.

Continued movement of the plug toward the block 16 causes the shoulder of the plug to clear the head 32, as shown in FIG. 3, as a result of which the shoulders 34 of the retainer members interlock with the shoulders 33, 35 of the plugs 12, 14 respectively.

This provides a through electrical connection as shown in FIG. 4, for the cords, so that the plugs 12, 14 are electrically connected, while being lockably engaged with the opposite ends of the connector device 10.

At such time as it is desired to disconnect one or both plugs from the connector device 10, one simply grasps the plug between the thumb and forefinger as shown in FIG. 6, and pressing the thumb and forefinger toward the connector device, against the beveled surfaces 37, one causes the spring arms to be spread apart to the dotted line positions shown in FIG. 6, thereby freeing the plug for full separation from the connector device 10.

It is worthy of note, in this regard, that when the plugs are fully connected to the connector device 10 as shown, for example, in FIG. 3, the beveled surfaces 37 form an acute angle with the adjacent side surfaces of the plug 12, adapted to receive the end of the thumb or forefinger, whereby to facilitate the spreading of the spring arms in the manner shown in FIG. 6.

In FIGS. 8 and 9, there is shown a modified form of the device wherein the body 36 of the connector is again molded of electrically insulative material, but in this instance is so shaped as to permit mounting therein of not only the pair of identical connector elements 22, but also a ground element 40 having a male end 41 (see FIG. 8) and a female end portion 43 mounted in slot 38 of body 36. This is a conventional grounded plug configuration for the ordinary residential electrical circuit, and hence it is not believed to require further discussion.

In this form of the invention, the retainer members are identical to those shown in FIGS. 1–7, and are permanently secured to the opposite faces of the body 36 in the same manner as in the first form of the invention.

In FIG. 8, the grounded plug 42 has shoulders 44, parallel prongs 13, and grounding prong 46, while the cooperating female connector 48 has shoulders 50. These engage the shoulders 34 in the same manner as in the first form of the invention, and disconnection is also accomplished in the same way as previously described herein.

In FIGS. 10–12 there is illustrated a modified form of the invention wherein the connector device has been generally designated 52. In this form of the invention, the device includes a band 58 integral with the retainer members, said retainer members having arms 60 provided on their distal ends with heads 62 similar to the heads previously described herein.

The band 58 slides upon the body 54 of the device. As a result, it can be slid in one direction, to one extreme position shown in FIG. 10, facilitating the insertion and locking of one of the plugs, in this instance the plug 42. Then, the band 58 can be slid in the opposite direction, leaving sufficient space to lockably engage the shoulders 50 of the plug 48.

In this form of the invention, the provision of a sliding connection may not only facilitate manufacture and assembly, but also permits a single connector block 54, with its associated male and female connector elements, to be assembled with any of various bands 58 and spring arms, designed to accommodate shoulders of different thicknesses on variously sized plugs 42 or 44. And, as previously noted, the sliding arrangement facilitates the connection, and may also facilitate the disconnection, of the plugs from the connector block.

This construction, like those previously described, has a particular value in the art, in that the construction permits manufacture at lower cost than is true of devices heretofore manufactured for similar purposes. Thus, although the devices previously manufactured may effectively accomplish locking and disconnection, they have been able to do so only by incorporating in the locking device a manufacturing expense higher than is desirable.

In FIGS. 13–15, there have been shown various forms of springable locking arm configurations that can be advantageously employed in practicing the invention. In FIG. 13, the construction is that which has been described in the several forms of the invention illustrated in FIGS. 1–12. In FIG. 14, the locking arm 68 on each end of a retainer member has a head 70 formed with a rearwardly directed shoulder 72 which is designed to engage in a hooking manner with a modified, mating, rearwardly directed shoulder on the plug being attached thereto; in this manner a stronger connection is provided. The beveled cam face 73 is similar, however, to that shown at 37 in the first form of locking arm described and illustrated herein.

In FIG. 15, the locking shoulder 78 is angled in the other direction from that illustrated in FIG. 14, that is, the locking shoulder 78 is oblique to the shoulder 44 of the plug 42. Again, there is provided a beveled cam face 80 similar to that previously described. In this case, when the plug is moved into engagement with the connector device, it engages the beveled face 80 of the head 76, and is lockably engaged by the face or shoulder 78. The shoulder 78 is at an obtuse angle to the length of the arm 74 to permit separation under excessive strain, as distinguished from the shoulder 72 which is at an acute angle to the length of the spring arm to afford maximum holding ability, and as distinguished also from the shoulder 34, which is at a right angle to the length of the spring arm. All forms of the invention are believed to be adapted for efficiently discharging their intended functions, and in all cases, the cam faces of the heads still describe an acute angle with the adjacent surfaces of the plugs with which they are lockably engaged, to facilitate disconnection whenever desired.

In FIG. 16, a further modification of the device includes the right-angled heads 32 at one end thereof and the obtuse-angled heads 76 at its other end. When the cords are pulled apart, it would be desirable that the connector remain on one of the cords.

In FIGS. 17–21, there is shown yet another form of the invention.

In this form, the yoke or retainer 56 is usable without the connector block 54 shown in FIG. 12. Instead, male and female plugs 112, 114 respectively are provided with male prongs 113 and female connector elements 115 which are per se conventional and which interengage directly when interlocked with the yoke 56.

In this form, the bodies of the plugs are molded or otherwise formed with rearwardly facing locking shoulders 133, 135 respectively. The locking shoulders are spaced substantial distances, in this instance, from the faces of the plugs. As a result, when the plugs are inserted between the spring arms 60 of the yoke or retainer, the leading edges of the plugs will cammingly engage, initially, the locking heads 62 of spring arms 60, and will spread them sufficiently to permit insertion of the plugs into direct, interlocking engagement with each other, the plugs being at this time in face-to-face contact as shown in FIG. 18.

When the plugs are fully inserted, into mating, face-to-face engagement with each other, the shoulders 133, 135 thereof will pass the locking heads, and will interlock with said heads as the heads spring back into position. The plugs are now fully interlocked against accidental separation.

When the plugs are to be disengaged, the user simply positions the thumb and forefinger at opposite sides of the body of the plug, rearwardly of the shoulders 133 or 135 as the case may be. Shifting the thumb and forefinger forwardly on the tapered opposed surfaces of the plug body effectively spreads the arms 60 apart as shown in FIG. 18, in which the right hand or male plug 112 is being freed from locking engagement with the retaining yoke 56.

Again, if desired, one of the plugs can be left in engagement with the retainer or yoke 56, awaiting the next locking connection of the plugs to each other.

Obviously, although in FIGS. 17–21 there have been illustrated 2-wire plugs having parallel prongs and female connector elements, the device can just as easily have any of various other conventional plug configurations, such as, for example, U-ground configurations such as those shown for the male and female plugs 42, 48 previously described herein.

It is also possible to utilize, as shown in FIGS. 19–21, a means for waterproofing the connection between the plugs 112, 114. There is illustrated in these figures of the drawing a generally rectangular gasket 80 which can, for example, be formed of relatively soft, compressible sealing material, preferably a material impervious to the passage not only of water or other liquids, but also one that would effectively resist or prevent the intrusion of corrosive substances.

In this instance, the gasket is simply fitted about the male prongs as shown in FIGS. 19 and 20. If U-ground plugs or other 3-wire configurations are being used, the gasket would be shaped to fit around all of the prongs projecting from the face of the plug.

When the plugs are inserted between the spring arms 60, the gasket 80 will be compressed between the faces of the plugs. An effective liquid-tight connection is thus provided, with the compression of the sealing ring 80 being maintained by interengagement of the shoulders of the locking heads 62 and the shoulders 133, 135 of the connected plugs.

It is also believed sufficiently obvious as not to require special illustration that the shoulders on the plugs and locking heads of the retaining yoke can be formed other than directly at right angles to the lengths of the spring arms. The yoke can, for example, assume the configuration shown in FIG. 16. Or both heads of the yoke can be as shown in FIG. 15. Or, one or both of the locking heads of the yoke can be as shown in FIG. 14 and the shoulders of the plugs can be angled in a complementary fashion. The omission of a connector block between the plugs does not change the effective utilization of the varying shapes and combinations of locking shoulders heretofore illustrated and described.

It is also possible to utilize more than a pair of opposing spring arms 60. This is shown in FIG. 22, showing a U-ground plug as seen from the rear. The plug generally designated 212 has three shoulders 233. It is used with a yoke 356 having locking heads 362 opposite each other in the same arrangement as previously described herein, but also having another locking head 364. These are on arms 360, 360 located opposite each other and on an arm 366 carrying the locking head 364. This arrangement may be desirable to assure even more effectively the locking of the U-ground plugs and the maintenance of a waterproof connection therebetween.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A device for mechanically and electrically connecting a pair of electrical cords, said cords having a mating male plug and female connector each of which is formed with shoulder means, said device comprising a retainer having:

(a) at least two opposed retainer members each of which is in the form of an elongated strip of springable material;

(b) locking heads on the strips adapted to interengage with the shoulder means of the mating plug and female connector responsive to insertion of the plug and connector between the strips; and (c) means providing a connection between the strips and spacing the strips apart a distance sufficient to permit insertion of the plug and connector into engagement with the locking heads thereof, said plug and connector being interengageable directly with each other in mating, electrical contact and wherein the shoulder means of the plug and connector are spaced apart a distance sufficient to engage said locked heads when the plug and connector are so interengaged with each other, said device further including a third strip having a locking head thereon, said plug and connector having shoulder means engaging the locking heads of all three strips when the plugs are in electrical contact.

2. A device as in claim 1 wherein the third strip is spaced laterally from the first named strips and has springable movement in a direction normal to the direction in which the first named strips may move.

3. A connector device for preventing accidental separation of a pair of electrical cords during normal use, said cords having mating male and female electrical connectors each having a shoulder means, said connector device comprising an elongated retainer adapted to be interposed between said connectors and having opposite but identical, wholly open ends aligned longitudinally of the retainer, each of said ends including at least one pair of opposed springable retainer members widely spaced apart transversely of the retainer, said open ends being aligned longitudinally of the retainer for insertion of the connectors into the retainer through the respective ends in the direction of their lengths, the retainer members at each end being resiliently spreadable by the connector inserted therebetween and including facing locking heads springable into releasable engagement with said shoulder means responsive to said insertion whereby to lock the inserted connectors against accidental withdrawal from the retainer, the members at each end of the retainer being resiliently spreadable independently of the members at the other end thereof whereby to permit removal of a selected one of the connectors from the retainer while leaving the other connector in engagement therewith, the locking heads of the strips at one of said ends being spaced longitudinally of the retainer from the locking heads at the other end thereof a distance closely approximately the distance between the shoulder means of the respective connectors when both connectors have been fully inserted, said retainer being formed as an open ended, sleeve-like band proportioned for extension of both of said connectors into the respective, open ends of the band, the respective pairs of retainer members being rigid at one end with said band and extending from the band longitudinally of the retainer in opposite directions to receive the inserted plugs and guide the same into the open ends of the bands into mating engagement with respect to each other, said connector device further including a sealing gasket of compressible material proportioned to be disposed between the inserted connectors and to be compressed thereby when both of said connectors are lockingly engaged by the locking heads, said band extending about the connectors and gasket when the connectors are engaged by the locking heads to enclose the gasket in the seal area between the connectors.

4. A device as defined in claim 3 wherein the distance between the locking heads is selected to require compression of the gasket to a predetermined extent effective to provide a seal of constant value between the connectors in response to each locking engagement of the several locking heads with the shoulder means of the male and female connectors.

5. A one piece connector device for mechanically preventing accidental separation of a pair of electrical cords during normal use and for permitting separation under severe stress, said cords having a mating male plug and female connector each of which is formed with face ends and rear shoulder means, said device comprising a centrally located retainer portion, said centrally located retainer portion being rectangular parallelepiped in shape having four equal length parallelogram sides, two of which are wider than the other two, with like sides opposite each other, providing two larger and two smaller parallelograms, the ends of the rectangular parallelepiped shape defined by the four sides being fully open to permit snug entry of a like contoured male plug or female connector into either end; four identical elongated strips of springable material at the open ends, integral with and extending parallel from the ends of the smaller parallelograms and terminating in shouldered locking heads to interengage with shoulder means of the mating male plug and female connector, responsive to insertion of the plug and connector between the strips; said device having two of the springable strips integral with and extending parallel from one end a distance sufficient to reach the shoulders of a mating male plug and female connector, two of said strips having portions that are turned at right angles toward each other constituting shoulder locking means of the locking heads, said strips continuing from the shoulder locking means in a curved flaring manner away from each other constituting cam surfaces adapted to be engaged by the face ends of the plug and connector responsive to movement of the plug and connector toward the position in which they mate, whereby to bias the ends of the strips outwardly against the spring tension thereof to a position in which the shoulders of the plug and connector will be free to interengage with the shoulders of the locking heads when the plug and connector are completely together, said device including two other springable strip portions integral with and extending parallel from the other end a distance sufficient to reach the shoulders of the mating male plug and female connector, at least two of the several springable strip portions being turned at obtuse angles toward each other constituting obtuse angled shoulder locking means of the locking heads to permit separation under great stress, said last named springable strip portions continuing from the obtuse angled shoulder locking means in a curved flaring manner constituting cam surfaces adapted to be engaged by the face ends of the plug and connector responsive to movement of the plug and connector toward the position in which they mate, whereby to bias the ends of the strips outwardly against the spring tension thereof, to the position in which the obtuse angled shoulders of the locking heads will be free to interengage with the shoulder means of the plug and connector when the plug and connector are completely together.

6. A device as in claim 5 in which the plug and connector are interengageable directly with each other in mating, electrical contact and wherein the shoulder means of the plug and connector are spaced apart a distance sufficient to engage said locking heads when the plug and connector are interengaged with each other.

7. A device as in claim 6 wherein said cam surfaces of the locking heads have extended portions that may be urged apart by the thumb and forefinger of one's hand to permit easy separation of the male plug and female connector.

8. A device as in claim 5 further including gasket means disposable between the plug and connector when the plug and connector are interengaged, wherein the gasket means is in the form of a compressible sealing ring, the locking shoulders of the strips being spaced apart a distance such as to cause the sealing ring to be compressed between the plug and connector responsive to interengagement of the shoulder means of the plug and connector with the locking heads, said device being adapted to maintain the same degree of compression on the sealing ring each time the plug and connector are in mating, electrical contact with their shoulder means locking engaged the locking heads forced together and left together.

* * * * *